US005819567A

United States Patent [19]

Eden, Jr.

[11] Patent Number: 5,819,567

[45] Date of Patent: Oct. 13, 1998

[54] LOCK SYSTEM WITH KEY TRAPPING

[75] Inventor: Charles W. Eden, Jr., Plantsville, Conn.

[73] Assignee: International Security Products, Inc., Southington, Conn.

[21] Appl. No.: 683,848

[22] Filed: Jul. 19, 1996

[51] Int. Cl.[6] ..... E05B 11/06

[52] U.S. Cl. ..... 70/390; 70/389; 70/406; 70/419

[58] Field of Search ..... 70/375, 389, 390, 70/419, 420, 409, 407, 406, 495, 492

[56] References Cited

U.S. PATENT DOCUMENTS

| | | | |
|---|---|---|---|
| 915,317 | 3/1909 | Thomas | 70/492 |
| 2,151,245 | 3/1939 | Swilens | 70/492 |
| 4,085,601 | 4/1978 | Sauder | 70/495 |
| 4,377,082 | 3/1983 | Wolter | 70/409 |
| 4,377,940 | 3/1983 | Hucknell | 70/495 |
| 4,393,673 | 7/1983 | Widen | 70/495 |
| 4,787,225 | 11/1988 | Hauser et al. | 70/407 |
| 4,869,085 | 9/1989 | Meissner | 70/409 |

FOREIGN PATENT DOCUMENTS

| | | | |
|---|---|---|---|
| 2910886 | 10/1980 | Germany | 70/409 |
| 3643188 | 6/1988 | Germany | 70/371 |

*Primary Examiner*—Steven N. Meyers
*Assistant Examiner*—Tuyet-Phuong Phan
*Attorney, Agent, or Firm*—Alix, Yale & Ristas, LLP

[57] ABSTRACT

A novel lock system utilizes a cylinder lock and a companion key with a projection extending from one side thereof to improve security. The cylinder lock comprises a shell, a core which is rotatably mounted within the shell and a plurality of pin tumbler stacks normally prevent movement between the shell member and the core. Shear lines are defined between the shell and the core, and also within each tumbler stack. The core also includes an outer surface, a longitudinal keyway and a cut-out which is normally offset from, but alignable with, at least one of the tumbler stacks. A plate member is disposed within the cut-out for movement between a first position, wherein the plate member acts as an extension of the core surface to prevent a tumbler stack from entering the cut-out and a second position, wherein the plate member does not prevent a tumbler stack from entering the cut-out. Upon insertion of an authorized key, the key bitting will appropriately align the tumbler shear lines with the shell/core shear line, and the key projection will urge the plate from the second position to the first position and thereby permit the core to rotate to an unlocked position. Upon insertion of a properly bitted key which does not possess an appropriate key projection, however, only partial core rotation is permitted whereupon a tumbler stack enters the cut-out to thereby render the lock inoperable and trap the unauthorized key within the keyway.

26 Claims, 6 Drawing Sheets

LOCK SYSTEM WITH KEY TRAPPING

BACKGROUND OF THE INVENTION (1) Field of the Invention

The present invention relates to enhancements in the providing of security to areas through which access is afforded by means of a door and, particularly, to increasing the difficulty of obtaining an unauthorized key for operation of a lock installed in such a door. More specifically, this invention is directed to mechanical locking systems and, especially, to a novel lock and key which, in combination, provide access control, the lock "trapping" any other key which is employed in an attempt to defeat the lock. Accordingly, the general objects of the present invention are to provide novel and improved methods and apparatus of such character.

(2) Description of the Prior Art

Mechanical locks which employ one or more linear arrays of pin tumbler stacks are, of course, well known in the art. The pin tumbler stacks of such locks are radially displaceable, with respect to the axis of rotation of a plug or core, in response to insertion of a key in a keyway provided in the core. The pin tumbler stacks comprise at least an upper or driver pin, which is spring biased toward the axis of core rotation, and a driven or bottom pin. A properly bitted key will cause pin tumbler stack displacement which, typically, causes the interface between the axially aligned driver and bottom pins to be coincident with a shear line defined by the core outer circumference. Thus, a properly bitted key will permit the core, with the bottom pins, to rotate within a shell. Core rotation will, through the action of a cam or tailpiece connected to the core, cause operation of a latch mechanism.

Locks of the type generally discussed above are known in the art as "cylinder" locks. The most common manner of defeating a cylinder lock consists of "manufacture" of an unauthorized key. It is believed fair to state that it is not possible to ensure against defeat simply by designing an intricate keyway and/or through the use of various arrangements of pin tumbler stacks. Thus, there has been a long-standing desire for a lock which affords increased security and, particularly, a lock which will "trap" any unauthorized key, particularly a partly formed key which is being "patterned" in an attempt to defeat the lock. In addition to key trapping, a high level of security also dictates a unique combination of a lock and key, i.e., a lock system, which affords the lock manufacturer the ability to exercise key control by means of being the sole source of the key portion of the system.

SUMMARY OF THE INVENTION

The present invention overcomes the above-briefly discussed and other deficiencies and disadvantages of the prior art and, in so doing, provides a novel lock system which is characterized by the use of a key having a unique security feature and which will "trap", i.e., mechanically capture in the keyway, any incorrect key which, lacking the unique security feature, is nevertheless bitted so as to displace the pin tumblers to a position which will enable rotation of the core relative to the shell.

A lock system in accordance with the invention includes a cylinder lock with a core in which, at the longitudinal position of at least one pin tumbler stack, is provided with a cut-out which is generally in the shape of a circular segment. With the lock in the locked state, i.e., prior to rotation of the core relative to the shell, this circular segment will be out of alignment with the pin tumbler stack. The cut-out is in communication with the keyway via an opening provided in a side of the keyway. A plate member or segment is inserted in the cut-out, the plate member being sized and shaped so as to be capable of limited movement within the cut-out and relative to the core, such movement being guided by the internal diameter of the shell. Movement of the plate member may be produced by a unique security feature, namely a camming projection, provided on the side of an authorized key. This camming projection extends through the opening in the keyway side. This camming projection is sized and shaped to protrude outwardly beyond the plane of the side of the blank from which the key was formed and into the circular sector. The plate member, when caused to move along a path defined by the shell internal diameter in response to contact with a camming projection on an authorized key, will function as an extension of the core and will present an edge which generally corresponds to the shear line. Thus, with an authorized key in the keyway, the core will appear to be uninterrupted to the driver pin of a pin tumbler stack at the location of the cut-out. However, in the case of an unauthorized key, core rotation will cause the outer periphery of the plate member to be displaced below the shear line and, in part, to define an opening into which the driver pin will move once the core has been rotated relative to the shell sufficiently to fully register the pin tumbler chamber in the shell with the cut-out in the core. The driver pin will, accordingly, move radially toward the axis of core rotation so as to bridge the shear line and prevent further core rotation in either the clockwise or counter-clockwise direction. The lock will thus be rendered inoperable and the unauthorized key will be trapped in the keyway.

BRIEF DESCRIPTION OF THE DRAWINGS

The present invention may be better understood, and its numerous objects and advantages will become apparent to those skilled in the art, by reference to the accompanying drawings wherein like reference numerals refer to like elements in the several figures and in which.

DESCRIPTION OF THE DISCLOSED EMBODIMENT

Figure 1:
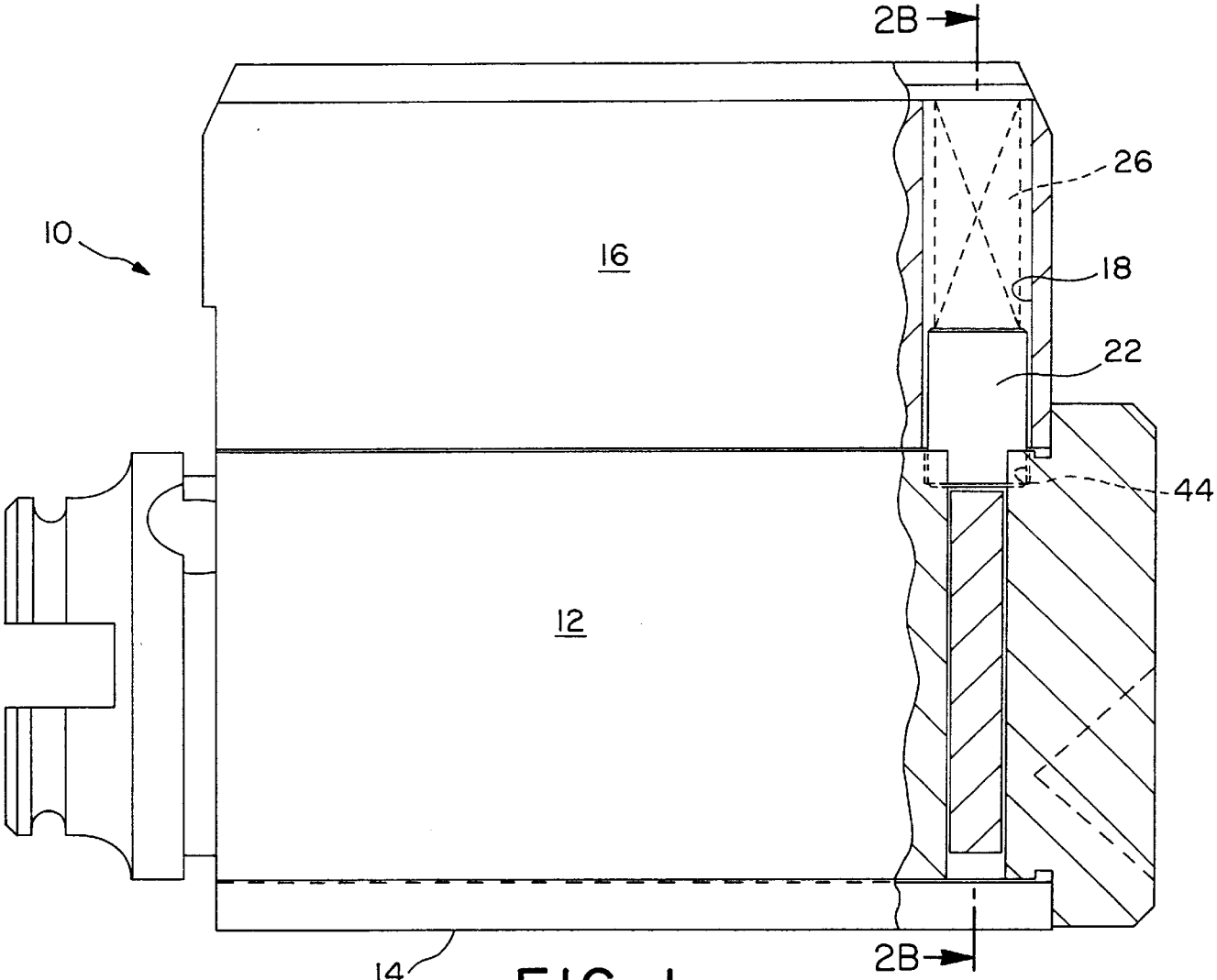
FIG. 1 is a side elevation view, partly in section, of a lock in accordance with the present invention.

With reference jointly to FIGS. 1–4, a cylinder lock in accordance with the present invention is indicated generally at 10. Lock 10 comprises a core 12 which may be rotated, about an axis of rotation, relative to a shell 14. Shell 14 includes an extension or bible 16. In the disclosed embodiment, a single linear array of pin chambers, such as chamber 18, are provided in bible 16. The pin chambers 18, with the lock in the locked state as depicted in FIGS. 2*a* and 3*a*, are in registration with pin chambers 20 in core 12. In the disclosed embodiment, pin tumbler stacks comprising an upper or driver pin 22 and a driven or bottom pin 24 are provided in the registered pin chambers. The driver pins 22 are resiliently biased, by means of compression springs 26, radially in the direction of the axis of rotation of core 12. A tailpiece or cam, not shown, will be connected to the end of core 12 disposed at the right as the lock is shown in FIG. 1. The tailpiece will be coupled to a latch mechanism or the like so that the lock may be employed to selectively prevent and permit access to a space on one side of a door in which the lock is installed.

The lock as described above is of conventional construction. It will thus be understood by those skilled in the art that the configuration and location of the pin chambers and pin tumbler stacks may be varied without departing from the invention. For example, there may be multiple arrays of pin chambers, radially offset from one another, and the stacks may include any number of pins.

Also in accordance with conventional construction, a keyway 28 (see FIG. 2*a*) is provided in core 12, the keyway defining a plane. In the disclosed embodiment, the axes of the pin chambers 18 lie in this plane. The keyway communicates with the pin chambers 20 in the core and has a unique profile, i.e., cross-section, as chosen by the lock manufacturer. A conventional keyway includes a plurality of wards which, in part, define the keyway cross-section. A key which will operate lock 10, i.e., a key which may be inserted in the keyway, must have a blade with side surfaces cut so as to be complementary with these wards. Thus, starting from a key blank with parallel sides, longitudinal cuts may be made so that the blade cross-section matches the keyway cross-section. Additionally, considering the lock depicted in the drawings as an example, the lock having a single linear array of pin tumbler stacks, one edge of the key blade must also be cut, i.e., bitted, such that, upon insertion of the key into the keyway, contact between the irregular upper edge of the key and the bottom pins will, as depicted in FIGS. 2 and 3, move the pin tumbler stacks against the bias of the springs 26 so as to place the interface between the driver and bottom pins at the shear line between the core 12 and shell 14. Thus, in a conventional cylinder lock, in order to permit relative rotation between the core and shell, the key blank must be provided with longitudinal cuts on the sides to define a profile which matches the keyway cross-section and a key blank having the correct profile must be cut on an edge in accordance with the lock combination defined by the variable length pins which define the individual pin tumbler stacks.

In accordance with the present invention, at the location of at least one of the pin tumbler stacks, a circular segment is cut out of core 12. This segment is defined by a wall 30 on core 12 which, with the exceptions to be discussed below, is straight and continuous between two points of intersection with the shear line. In the disclosed embodiment, the spacing between keyway 28 and wall 30 increases from a first end of the wall located adjacent the bottom of the keyway to an opposite end of wall 30 which is adjacent the outer end of a pin chamber 20 in core 12. An opening 32 in wall 30 provides communication between the keyway and the space formed by the circular segment cut-out. In the disclosed embodiment, the opening 32 is formed by a semi-circular groove which forms a portion of the keyway profile. Restated, in the region of the circular segment cut-out, the radius of the groove which in part defines the keyway exceeds the thickness of the wall separating the cut-out from the keyway, thus forming an opening 32 with arcuate side walls. The opening 32 is located at the opposite side, when compared to the pin tumbler chamber 20, of a plane which extends through the core axis of rotation and is transverse to the axis of chamber 20.

A movable plate member 34 having a shape which is similar to, but different from, the circular segment cut-out defined by wall 30 is inserted in the cut-out. Plate 34 has a first, straight side 36 which faces wall 30. Side 36 is provided with a cam follower projection 38 which extends into opening 32. Plate 34 also has an arcuate side 40 which extends from a first end of side 36, the radius of side 40 being substantially the same as the radius of core 12. Arcuate side 40 terminates at, i.e., merges with a second side surface 42, which may either be straight or curved as shown, which extends to the second end of side 36, i.e., the end of side 36 which is disposed above the plane of the top of the keyway as the lock is depicted in FIGS. 2 and 3. The width of plate 34 is, as may best be seen from FIG. 1, less than the diameter of the pin chamber 18 in bible 16. Core 12 is provided with a blind hole or recess 44 which, in part, extends into wall 30. Hole 44 has a size and shape complementary to the lower end of a driver pin 22. The axis of hole 44 intersects the circular segment cut-out. Consequently, plate 34 extends into, and may effectively bridge, blind hole 44. Depending on the position of plate 34, access of pin 22 to hole 44 will either be permitted or blocked. The position of plate 34 is controlled in the manner to be described below.

Figure 5:
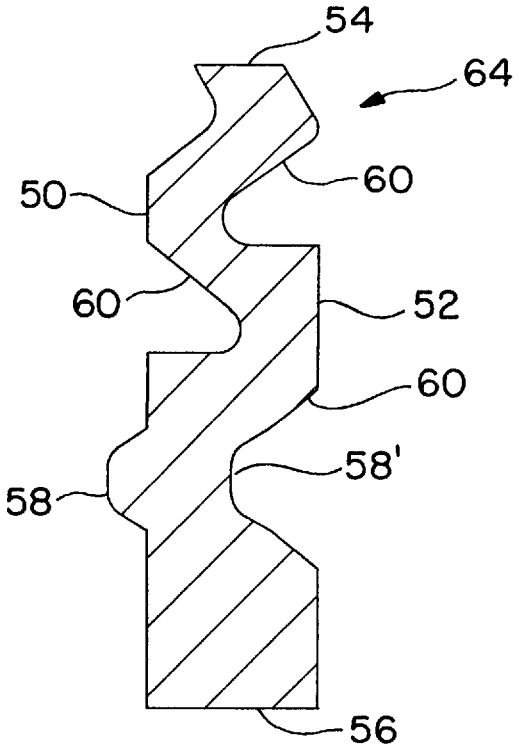
FIG. 5 is a cross-sectional view, taken along line 5—5 of FIG. 4*b*, of the key blank of FIGS. 4*a* and 4*b*.
Figure 6A:
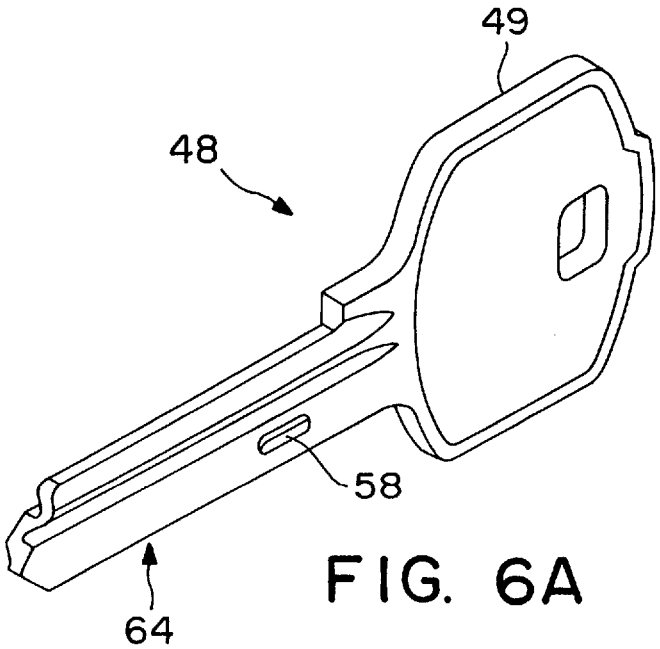
FIGS. 6*a* and 6*b* are perspective views of the key blank of FIGS. 4*a* and 4*b*.
Figure 6B:
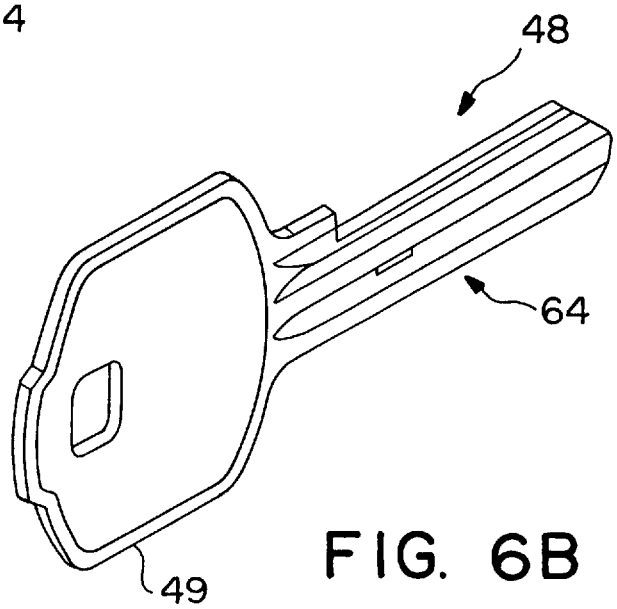

A key in accordance with the invention is indicated at 46 in FIG. 3. The blank from which key 46 was cut is indicated at 48 in FIGS. 4 and 6. The blade portion of key blank 48, indicated generally at 64, extends from a bow 49 and has a pair of opposite, planar sides 50 and 52, the spacing between the planes of sides 50 and 52 (before the key profile defining longitudinal cuts are made) defining the maximum blade width, and top and bottom edges 54 and 56. Where key blank 48 deviates from the prior art is in the provision of a camming projection 58 on side 50 of the blade. Camming projection 58 is preferably elongated, as may be seen from FIGS. 4*a* and 6*a*, and has a cross-section which is generally complementary to that of the groove which defines opening 32. A recess 58' is formed in the opposite side of blade 64 in registration with projection 58 as may be seen from FIGS. 4, 5 and 6. Recess 58' has a size and shape which is generally complementary to the size and shape of projection 58. Projection 58 is also located below the center line of the blade. Blank 48 will also be provided with longitudinal cuts 60 along the side(s) of the blank as required by the wards in the keyway. A key for operation of lock 10 may be produced by cutting the top edge 54 of blank 48 to provide flats, i.e., the bitting, which will be in registration with the pin tumbler stacks with the key fully inserted in the keyway, these flats being at a "height" so as to displace the individual pin tumbler stacks as appropriate to satisfy the lock combination. A particularly unique feature of key blank 48 resides in the extension of projection 58 beyond the plane of side 50 as best seen from FIGS. 5 and 6*a*.

Figure 2B:
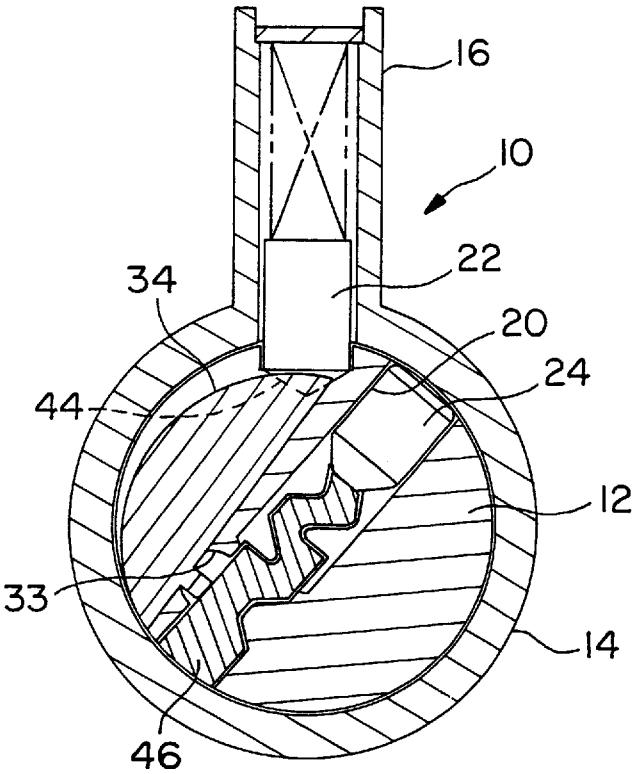
FIGS. 2*a* and 2*b* are, respectively, cross-sectional side elevation views of the lock of FIG. 1 depicting an attempt to operate the lock with an unauthorized key, FIG. 2*a* depicting key insertion and FIG. 2*b*, which is taken along line 2*b*—2*b* of FIG. 1, depicting partial rotation and key trapping.
Figure 2A:
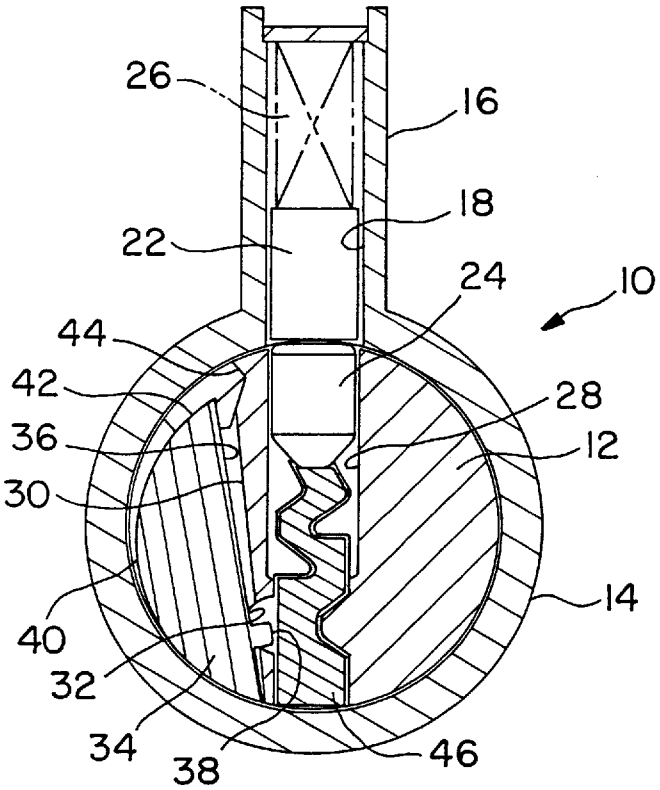

Referring to FIG. 2, insertion in keyway 28 of an unauthorized key 66 which satisfies the lock combination save for the camming projection 58 will displace all of the pin tumbler stacks to positions which will permit rotation of core 12 within shell 14. As the core is rotated in the clockwise direction, it will carry the plate member 34. After a relatively small degree of rotation, as depicted in FIG. 2*b*, the plate member will "flop" over so that the side 36 thereof abuts the wall 30, this "flopping" action resulting from either or both of interaction between spring biased driver pin 22 and plate 34 or the influence of gravity. When rotation continues to the point where blind hole 44 is in registration with pin chamber 18, the driver pin 22 will, under the influence of spring 26, be driven into blind hole 44 until it bottoms on the top, i.e., the side 42, of plate member 34. At this point, because driver pin 22 will bridge the shear line, further rotation of the core in either a clockwise or counter-clockwise direction, will be prevented. Additionally, because of the interaction between the immobilized bottom pins and the top edge of the key blade, the unauthorized key 66 will be trapped in the keyway, i.e., will not be removable.

Figure 3B:
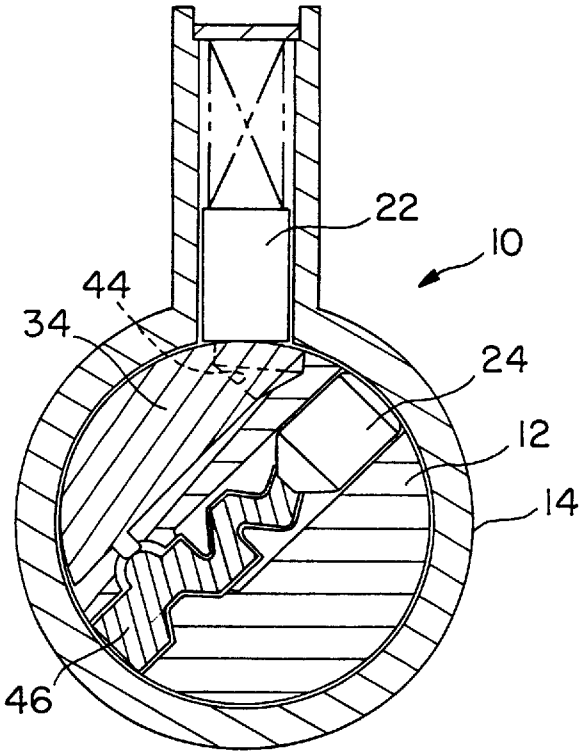
FIGS. 3*a* and 3*b* are views similar to FIGS. 2*a* and 2*b* but depicting operation of the lock with an authorized key.
Figure 3A:
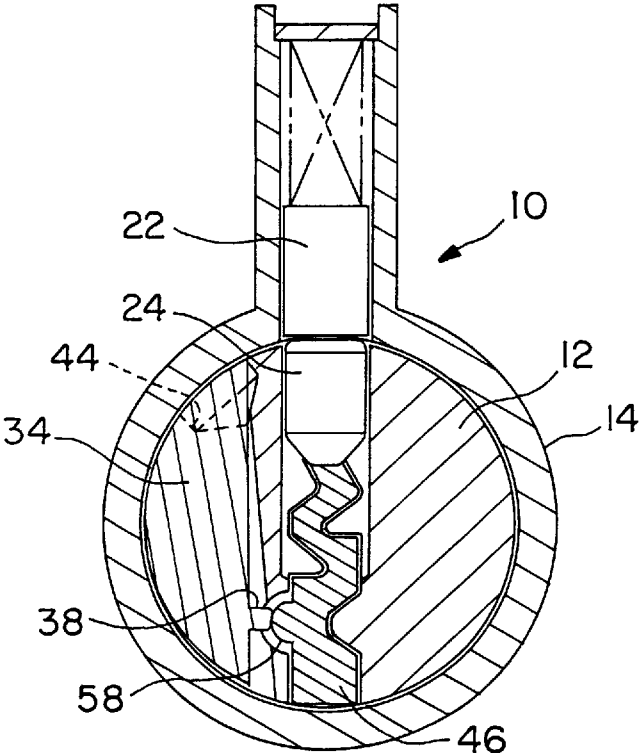
Figure 4A:
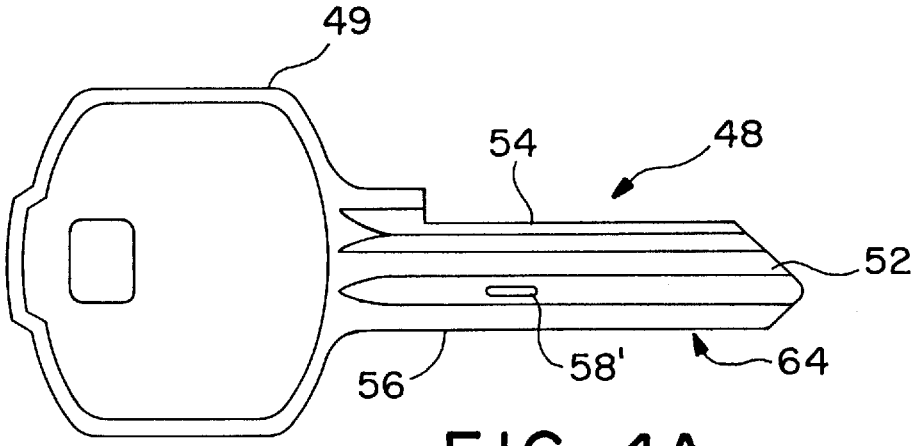
FIGS. 4*a* and 4*b* are respectively front elevation and rear elevation views of a key blank in accordance with the invention.
Figure 4B:
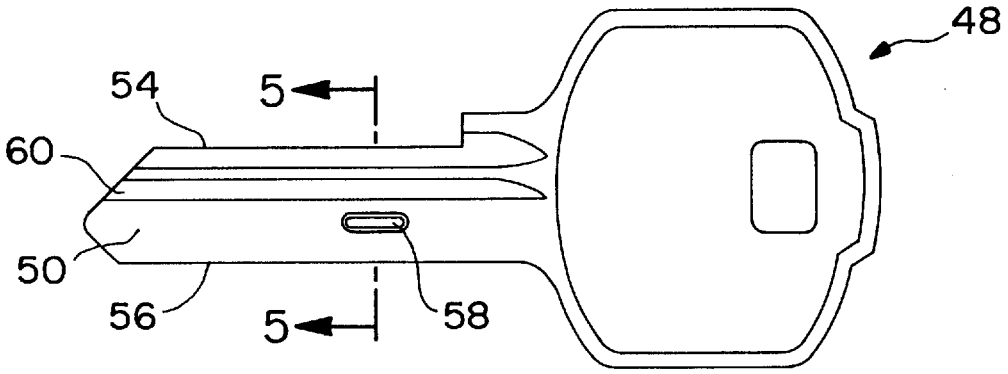

If the above-described trapping action is desired for both the clockwise and counter-clockwise directions of rotation of core 12 from the position of FIGS. 2*a* and 3*a*, a second plate member 34' (not shown) will be provided and a second camming projection will be formed on the side of the key blade oppositely disposed with respect to projection 58.

As may be seen from FIG. 3, the insertion of an authorized key in keyway 28 will result in the establishment of contact between camming projection 58 and the projection 38 on plate member 34. This contact will impart clockwise movement, relative to core 12, of the plate member 34, i.e., the projection 38 functions in the manner of a cam follower and, in so doing, drives the plate member 34 with which it is integral. This movement will be guided by the inner diameter of shell 14 and thus plate member 34 will be driven upwardly such that the junction of sides 36 and 42 is in an abutting relationship with the upper end of wall 30. This abutting relationship causes side 42 of the plate member to bridge blind hole 44. Accordingly, when the core 12 is rotated within shell 12, side 42 of plate 34 will initially prevent driver pin 22 from entering blind hole 44 to a significant degree and, as rotation of the core continues to the position shown in FIG. 3*b*, the arcuate side 40 will contact the bottom of driver pin 24 and cam driver pin against the bias of spring 26 so that rotation of the core to the unlocked position may be accomplished.

While a preferred embodiment has been described, various modifications and substitutions may be made thereto without departing from the spirit and scope of the invention. Accordingly, it is to be understood that the present invention has been described by way of illustration and not limitation.

What is claimed is:

1. A cylinder lock system comprising:

a key, said key having a bow portion and a blade which longitudinally extends from said bow portion, said blade having a pair of spaced side surfaces which are at least in part substantially parallel and interconnected by a pair of edges extending therebetween, said key blade being provided with surface irregularities which define the key bitting, said key further having a camming projection extending laterally from one of said side surfaces;

a shell having a longitudinal axis and an engagement surface traversing an interior portion thereof, said shell defining at least a first longitudinal row of pin tumbler receiving chambers which are in communication with said engagement surface;

a core mounted within said shell for rotation about said longitudinal axis, said core having an outer surface and defining a longitudinally extending keyway, said core also having at least a first row of pin tumbler receiving chambers which are alignable with said shell pin tumbler receiving chambers and which extend between said keyway and said core outer surface, said core further having a first blind hole which is offset from but alignable with at least one of said shell pin tumbler receiving chambers, a first shear line being defined between said shell engagement surface and said outer surface of said core;

a plurality of pin tumblers, said pin tumblers being reciprocally mounted within said core and said shell pin tumbler receiving chambers when said chambers are in alignment, each of said pin tumblers comprising a bottom pin which is normally biased into said keyway and at least a driver pin which normally abuts said bottom pin to define a tumbler shear line therebetween, said pin tumblers normally coacting with said core and said shell to prevent rotation of said core relative to said shell; and a key trapping plate movably disposed within said core for movement between a first position, wherein said plate permits at least one of said driver pins to cross said first shear line and enter into said blind hole, and a second position wherein said plate prevents said one driver pin from crossing said first shear line;

insertion of said key into said keyway causing said camming projection to contact said plate and resulting in said camming projection moving said plate from said first position to said second position, insertion of said key into said keyway also establishing contact between said surface irregularities and said bottom pins resulting in said key blade surface irregularities causing reciprocation of said pin tumblers such that said tumbler shear lines are placed in registration with said first shear line to thereby permit rotation of said core relative to said shell.

2. A cylinder lock system as recited in claim 1, wherein said outer surface of said core is generally cylindrically shaped, wherein said core defines a cut-out which is at least partially alignable with said one of said shell receiving chambers, and wherein said plate is disposed within said cut-out for movement relative to said core.

3. A cylinder lock system as recited in claim 2, wherein said plate includes a bearing surface which is contoured to generally form a first shear line extension of said outer surface of said core when said plate is in said second position and to be displaced in the direction of said longitudinal axis from said first shear line when said plate is in said first position.

4. A cylinder lock system as recited in claim 3, wherein said cut-out is in communication with said keyway, wherein said plate includes a projection which at least partially extends into said keyway when said plate is in said first position and wherein said plate projection does not substantially extend into said keyway when said plate is in said second position.

5. A cylinder lock system as recited in claim 2, wherein said cut-out is in communication with said keyway, wherein said plate includes a projection which at least partially extends into said keyway when said plate is in said first position and wherein said plate projection does not substantially extend into said keyway when said plate is in said second position.

6. A cylinder lock system as recited in claim 5, wherein said cut-out extends into said keyway at a portion thereof which is located opposite said core pin tumbler receiving chambers with respect to said longitudinal shell axis.

7. A cylinder lock system as recited in claim 6, wherein said key projection engages said plate projection to move said plate from said first position to said second position.

8. A cylinder lock system as recited in claim 5, wherein said cut-out extends into said keyway at a portion thereof which is located opposite said core pin tumbler receiving chambers with respect to said longitudinal shell axis.

9. A cylinder lock system as recited in claim 5, wherein said key projection engages said plate projection to move said plate from said first position to said second position.

10. A cylinder lock system as recited in claim 2, wherein said key projection is an elongated projection which extends along the longitudinal direction of said blade.

11. A cylinder lock system as recited in claim 1, wherein said plate includes a bearing surface which is contoured to generally form a first shear line extension of said outer surface of said core when said plate is in said second position and to be displaced in the direction of said longitudinal axis from said first shear line when said plate is in said first position.

12. A cylinder lock system as recited in claim 11, wherein said key projection is an elongated projection which extends along the longitudinal direction of said blade.

13. A cylinder lock system as recited in claim 1, wherein said key projection is an elongated projection which extends along the longitudinal direction of said blade.

14. A cylinder lock system as recited in claim 1, wherein said key blade side surfaces extend substantially the length of said blade and define a pair of substantially parallel planes, the spacing between said parallel planes defining the maximum thickness of said blade, and wherein said camming projection extends beyond a first of said parallel planes, said key blade further having a recess located in registration with said camming projection, said recess being in the side surface of said blade disposed oppositely with respect to said one side surface.

15. A cylinder lock comprising:

a shell, said shell having a forward end, a longitudinally spaced rear end and a longitudinal axis extending therebetween, said shell having an interior surface which defines a core-receiving chamber arranged coaxially with respect to said axis, said shell further having at least a first longitudinal row of pin tumbler receiving chambers, said chambers having axes and communicating with said interior surface, said chamber axes and said longitudinal axis cooperating to define a first plane;

a core disposed within said core receiving chamber of said shell for rotation about said longitudinal axis, said core including a longitudinally extending keyway having opposite sides, said core also including at least a first row of pin tumbler receiving chambers, said core pin tumbler receiving chambers each having an axis and being axially alignable with an associated one of said shell pin tumbler receiving chambers, said core having a generally cylindrical outer surface which cooperates with said shell to define a first shear line therebetween, said core pin tumbler receiving chambers extending between said keyway and said core outer surface, said core additionally having a cut-out at the longitudinal location of one of said core pin tumbler receiving chambers, said cut-out extending into said core from said cylindrical outer surface thereof on one side of said keyway, said cut-out being in communication with said keyway via an opening in a side of said keyway, said cut-out at least in part defining a recess in said core outer surface at said longitudinal location, said recess being angularly offset from the axis of said one core pin tumbler receiving chamber, said recess being registrable with a shell pin tumbler receiving chamber by rotation of sad core relative to said shell, said recess having a cross-sectional size and shape which is commensurate with the cross-sectional size and shape of the shell pin tumbler receiving chamber at said longitudinal location;

a plurality of pin tumblers, said pin tumblers each having at least a bottom pin and a driver pin, the pins of said pin tumblers being in axial alignment when said shell pin receiving chambers are in axial alignment with said core pin tumbler receiving chambers, said pin tumblers each further comprising a spring for biasing said pins in the direction of said keyway whereby said bottom pins may extend into said keyway and one pin of each of said pin tumblers may extend across said shear line to coact with said core and shell to prevent rotation of said core relative to said shell; and a plate disposed in said cut-out in said core, said plate being movable relative to said core between first and second positions, said plate having a first outer surface portion which, in said first position of said plate, is displaced from said shear line and, in said second position of said plate, is disposed at said shear line whereby said plate first outer surface portion selectively defines either a discontinuity in or substantially a continuation of said outer surface of said core, said plate effectively bridging said core outer surface recess when moved to said second position, said plate further having a projection located to extend into said keyway via said opening whereby force to impart movement to said plate may be delivered to said projection from a key inserted in said keyway.

16. A lock as recited in claim 15, wherein said cut-out in said core has generally the shape of a circular segment.

17. A lock as recited in claim 16, wherein said opening and said recess are located on opposite sides of a second plane, said second plane being generally transverse to said first plane and extending through said longitudinal axis.

18. A lock as recited in claim 16, wherein said plate further includes a second outer bearing surface which cooperates with said shell interior surface to guide movements of said plate relative to said core.

19. A lock as recited in claim 18, wherein said opening and said recess are located on opposite sides of a second plane, said second plane being generally transverse to said first plane and extending through said longitudinal axis.

20. A lock as recited in claim 18 wherein said cut-out in said core has a width which is less than the diameter of said one core pin tumbler receiving chamber and wherein said recess in said core outer surface is in part further defined by a blind hole which is intersected by said cut-out.

21. A lock as recited in claim 20, wherein said plate projection extends into said keyway when said plate is in said first position and wherein said projection is substantially displaced from said keyway when said plate is in said second position.

22. A lock as recited in claim 16, wherein said plate projection extends into said keyway when said plate is in said first position and wherein said projection is substantially displaced from said keyway when said plate is in said second position.

23. A lock as recited in claim 15, wherein said plate further includes a second outer bearing surface which cooperates with said shell interior surface to guide movements of said plate relative to said core.

24. A lock as recited in claim 23, wherein said plate projection extends into said keyway when said plate is in said first position and wherein said projection is substantially displaced from said keyway when said plate is in said second position.

25. A lock as recited in claim 15, wherein said plate projection extends into said keyway when said plate is in said first position and wherein said projection is substantially displaced from said keyway when said plate is in said second position.

26. A lock as recited in claim 15 wherein said cut-out in said core has a width which is less than the diameter of said one core pin tumbler receiving chamber and wherein said recess in said core outer surface is in part further defined by a blind hole which is intersected by said cut-out.

* * * * *